US007134504B2

(12) United States Patent
Doane et al.

(10) Patent No.: US 7,134,504 B2
(45) Date of Patent: Nov. 14, 2006

(54) EXPANDABLE PACKER WITH ANCHORING FEATURE

(75) Inventors: James C. Doane, Friendswood, TX (US); Jason M. Harper, Houston, TX (US); John Lindley Baugh, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 30 days.

(21) Appl. No.: 10/944,322

(22) Filed: Sep. 17, 2004

(65) Prior Publication Data

US 2005/0028989 A1 Feb. 10, 2005

Related U.S. Application Data

(62) Division of application No. 10/456,271, filed on Jun. 6, 2003, now Pat. No. 7,044,231, which is a division of application No. 10/117,521, filed on Apr. 5, 2002.

(60) Provisional application No. 60/344,314, filed on Dec. 20, 2001.

(51) Int. Cl.
*E21B 33/127* (2006.01)

(52) U.S. Cl. ..... 166/387; 166/120; 166/187; 166/382

(58) Field of Classification Search ..... 166/206, 166/207, 120, 380, 382, 387, 187; 277/331, 277/333, 334
See application file for complete search history.

(56) References Cited

U.S. PATENT DOCUMENTS

| | | | | |
|---|---|---|---|---|
| 2,159,640 A | | 5/1939 | Strom | |
| 2,652,894 A | | 9/1953 | Brown et al. | |
| 2,656,891 A | * | 10/1953 | Toelke | 166/63 |
| 3,097,696 A | | 7/1963 | Orr | |
| 3,139,140 A | * | 6/1964 | Brown | 166/120 |
| 3,203,483 A | * | 8/1965 | Renic | 166/207 |
| 3,272,517 A | | 9/1966 | Howard et al. | |
| 3,298,440 A | | 1/1967 | Current | |
| 3,776,307 A | | 12/1973 | Young | |
| 3,910,348 A | | 10/1975 | Pitts | |
| 4,069,573 A | | 1/1978 | Rogers, Jr. et al. | |
| 4,302,018 A | * | 11/1981 | Harvey et al. | 277/322 |
| 4,554,973 A | * | 11/1985 | Shonrock et al. | 166/192 |

(Continued)

FOREIGN PATENT DOCUMENTS

WO PCT/FR00/00784 10/2000

OTHER PUBLICATIONS

Cocks, G.; "Experimental Results of Work on Expanded Metal Packers from (Jun. 1980 to Mar. 1982," LANL Memorandum ESS-4-89-88 (Apr. 21, 1989).

(Continued)

*Primary Examiner*—Hoang Dang
(74) *Attorney, Agent, or Firm*—Steve Rosenblatt

(57) ABSTRACT

An expandable packer or anchor is disclosed. It features a gripping device integral to or mounted in a sleeve over the mandrel. Upon expansion, a sealing element engages an outer tubular and the gripping device, such as wickers on slips, preferably digs into the outer tubular. The expansion is preferably by pressure and can incorporate pressure intensifiers delivered by slick line or wire line. Release is accomplished by a release tool, which is delivered on slick line or wire line. It stretches the anchor or packer longitudinally, getting it to retract radially, for release. The release tool can be combined with packers or anchors that have a thin walled feature in the mandrel, to release by pulling the mandrel apart.

2 Claims, 18 Drawing Sheets

U.S. PATENT DOCUMENTS

| | | | | |
|---|---|---|---|---|
| 4,749,035 | A | 6/1988 | Cassity | |
| 4,784,226 | A | 11/1988 | Wyatt | |
| 4,817,716 | A * | 4/1989 | Taylor et al. | 166/277 |
| 4,832,125 | A | 5/1989 | Taylor | |
| 4,862,957 | A | 9/1989 | Scranton | |
| 5,069,280 | A | 12/1991 | McKee et al. | |
| 5,197,542 | A | 3/1993 | Coone | |
| 5,220,959 | A | 6/1993 | Yance, Sr. | |
| 5,348,095 | A | 9/1994 | Worrall et al. | |
| 5,366,012 | A | 11/1994 | Lohbeck | |
| 5,429,036 | A * | 7/1995 | Latos | 91/181 |
| 5,542,473 | A | 8/1996 | Pringle et al. | |
| 5,667,011 | A | 9/1997 | Gill et al. | |
| 5,720,343 | A | 2/1998 | Kilgore et al. | |
| 6,073,692 | A | 6/2000 | Wood et al. | |
| 6,098,717 | A | 8/2000 | Bailey et al. | |
| 6,145,598 | A * | 11/2000 | Carisella | 166/387 |
| 6,213,204 | B1 | 4/2001 | Doane | |
| 6,325,148 | B1 | 12/2001 | Trahan et al. | |
| 6,446,717 | B1 | 9/2002 | White et al. | |
| 6,513,600 | B1 | 2/2003 | Ross | |
| 6,527,049 | B1 | 3/2003 | Metcalfe et al. | |
| 6,591,905 | B1 | 7/2003 | Coon | |
| 6,598,678 | B1 | 7/2003 | Simpson et al. | |
| 6,631,759 | B1 * | 10/2003 | Cook et al. | 166/217 |
| 6,651,749 | B1 * | 11/2003 | Kilgore | 166/387 |
| 6,691,789 | B1 | 2/2004 | Jackson et al. | |
| 6,702,029 | B1 | 3/2004 | Metcalfe et al. | |
| 6,722,427 | B1 * | 4/2004 | Gano et al. | 196/217 |
| 6,832,654 | B1 * | 12/2004 | Ravensbergen et al. | 166/308.1 |
| 2002/0014339 | A1 | 2/2002 | Ross | |
| 2003/0042028 | A1 | 3/2003 | Lauritzen et al. | |
| 2003/0047320 | A1 | 3/2003 | Badrak et al. | |
| 2003/0047322 | A1 | 3/2003 | Maguire et al. | |
| 2003/0062171 | A1 | 4/2003 | Maguire et al. | |
| 2003/0205386 | A1 | 11/2003 | Johnston et al. | |
| 2003/0217844 | A1 | 11/2003 | Moyes | |

OTHER PUBLICATIONS

Smith, M.C.; "Use of a Hydraulically Bulged Liner for Hydraulic Fracturing in EE-2," LANL Memorandum, ESS-DOT (Nov. 12, 1981).

Murphy, H. and Bennett, G.; "Simplified stress Analysis of Hydraulically Expanded Liners," LANL Memorandum ESS-4 (Nov. 23, 1981).

Dreesen, D.S., Cocks, G. and Malzahn, M.; "Experimental Results—Expanding Metal 6⅝ in . OD Stainless Steel Packers Inside a 8¾ in. ID Steel Vessel," LANL Draft Memorandum ESS-4-89-92 (May 2, 1989).

Brochure from Owens Tools website, "X-Span Systems", CoreLab Downhole Solutions, Dec. 18, 2001, 6 pages.

Dreesen, D.S., SPE 22858, "Analytical and Experimental Evaluation of Expanded Metal Packers for Well Completion Service", Oct. 6, 1991, pp. 413-421.

* cited by examiner

EXPANDABLE PACKER WITH ANCHORING FEATURE

PRIORITY CLAIM

This application is a divisional application claiming priority from U.S. patent application Ser. No. 10/456,271 now U.S. Pat. No. 7,044,231, filed on Jun. 6, 2003, which is a divisional application claiming priority from U.S. patent application Ser. No. 10/117,521, filed on Apr. 5, 2002, which claims the benefit of U.S. Provisional Application No. 60/344,314, filed on Dec. 20, 2001.

FIELD OF THE INVENTION

The field of this invention relates to packers and more particularly to packers that can be set by expansion and more particularly incorporating an anchoring feature to engage the surrounding tubular upon physical expansion of the packer.

BACKGROUND OF THE INVENTION

Traditional packers comprised of a sealing element having anti-extrusion rings on both upper and lower ends and a series of slips above or/and below the sealing element. Typically a setting tool would be run with the packer to set it. The setting could be accomplished hydraulically due to relative movement created by the setting tool when subjected to applied pressure. This relative movement would cause the slips to ride up cones and extend into the surrounding tubular. At the same time, the sealing element would be compressed into sealing contact with the surrounding tubular. The set could be held by a body lock ring, which would prevent reversal of the relative movement, which caused the packer to set in the first instance.

As an alternative to pressure through the tubing to the setting tool to cause the packer to set, another alternative was to run the packer in on wire line with a known electrically operated setting tool such as an E-4 made by Baker Oil Tools. In this application, a signal fires the E-4 causing the requisite relative movement for setting the packer. Some of these designs were retrievable. A retrieving tool could be run into the set packer and release the grip of the lock ring so as to allow a stretching out of the slips back down their respective cone and for the sealing element to expand longitudinally while contracting radially so that the packer could be removed from the well.

In the past, sealing has been suggested between an inner and an outer tubular with a seal material in between. That technique, illustrated in U.S. Pat. No. 6,098,717, required the outer tubular or casing to be expanded elastically and the inner tubular to be expanded plastically. The sealing force arose from the elastic recovery of the casing being greater than the elastic recovery of the inner tubular, thus putting a net compressive force on the inner tubular and the seal. Other expansion techniques, described in U.S. Pat. Nos. 5,348,095; 5,366,012; and 5,667,011 simply related to expansion of slotted tubulars, serving as a liner in open hole, as a completion technique. U.S. Pat. No. 4,069,573 illustrates the use of expansion to form a tubular casing patch.

The present invention relates to packers that can be expanded into sealing position. The surrounding tubular does not need to be expanded to set the packer of the present invention. Rather, an anchor such as slips is used to support the expanded sealing element and hold it in a set position. Preferably, existing setting tools, with minor modifications can be used to expand the packer of the present invention.

Similarly releasing tools can be employed to remove the packer from its set position. The running string can be exposed to lower pressures than the packer through the use of pressure intensifiers. The expansion force can be pinpointed to the area of the packer, thus avoiding subjecting the formation or the running string to undue pressures during setting of the packer. Alternatively, the inner tubular may simply be an anchor for another tool or a liner string. The anchoring can be ridges on the exterior of the inner tubing directly or on a ring mounted over the inner tubular being expanded. The ring can be slotted to reduce the required expansion force.

The setting tool can be delivered through tubing on slick line or wire line or run into the well on rigid or coiled tubing or wire line, among other techniques. The release tool can be likewise delivered and when actuated, stretches the packer or anchor out so that it can be removed from the wellbore. Conventional packers, that have their set held by lock rings, can be released with the present invention, by literally pushing the body apart as opposed to cutting it downhole as illustrated in U.S. Pat. No. 5,720,343.

These and other advantages of the present invention will be more readily understood from a review of the description of the preferred embodiment, which appears below.

SUMMARY OF THE INVENTION

An expandable packer or anchor is disclosed. It features a gripping device integral to or mounted in a sleeve over the mandrel. Upon expansion, a sealing element engages an outer tubular and the gripping device, such as wickers on slips, preferably digs into the outer tubular. The expansion is preferably by pressure and can incorporate pressure intensifiers delivered by slick line or wire line. Release is accomplished by a release tool, which is delivered on slick line or wire line. It stretches the anchor or packer longitudinally, getting it to retract radially, for release. The release tool can be combined with packers or anchors that have a thin walled feature in the mandrel, to release by pulling the mandrel apart.

DETAILED DESCRIPTION OF THE PREFERRED EMBODIMENT

Figure 1:
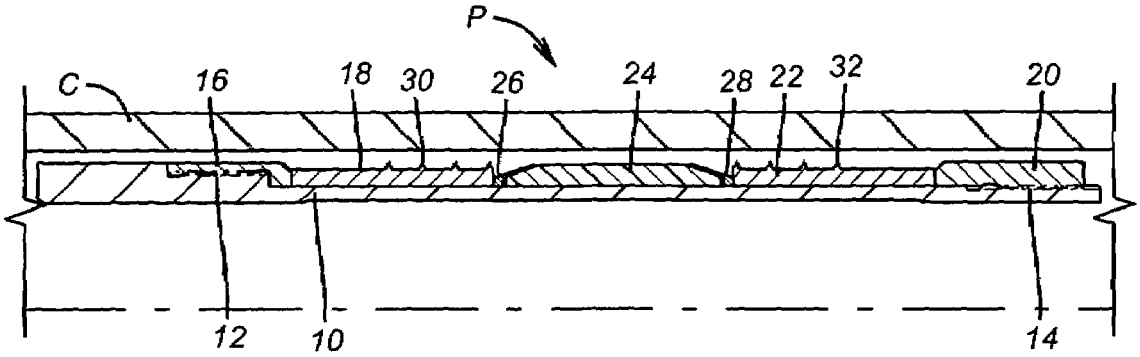
FIG. 1 is a section through the packer of the present invention in the run in position.
Figure 2:
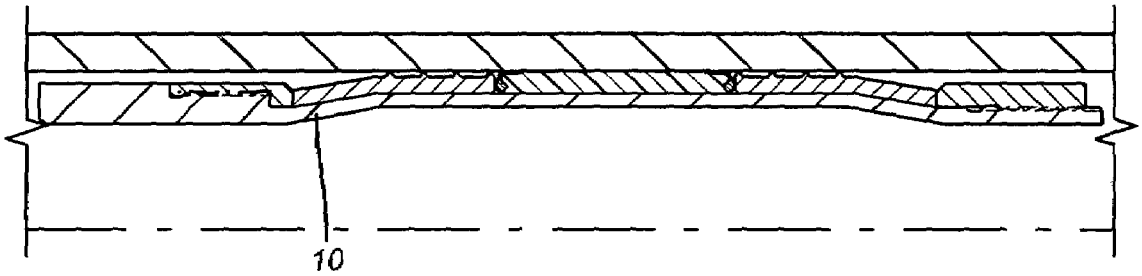
FIG. 2 is the view of FIG. 1 with the packer in the set position.
Figure 3:
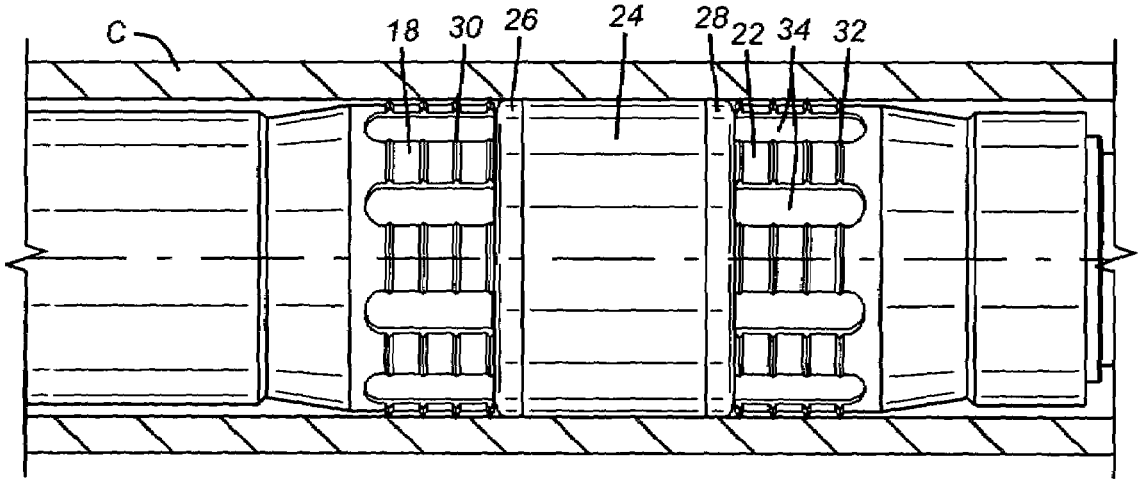
FIG. 3 is an outside view of the packer showing the slips on a ring with recesses.
Figure 4A:
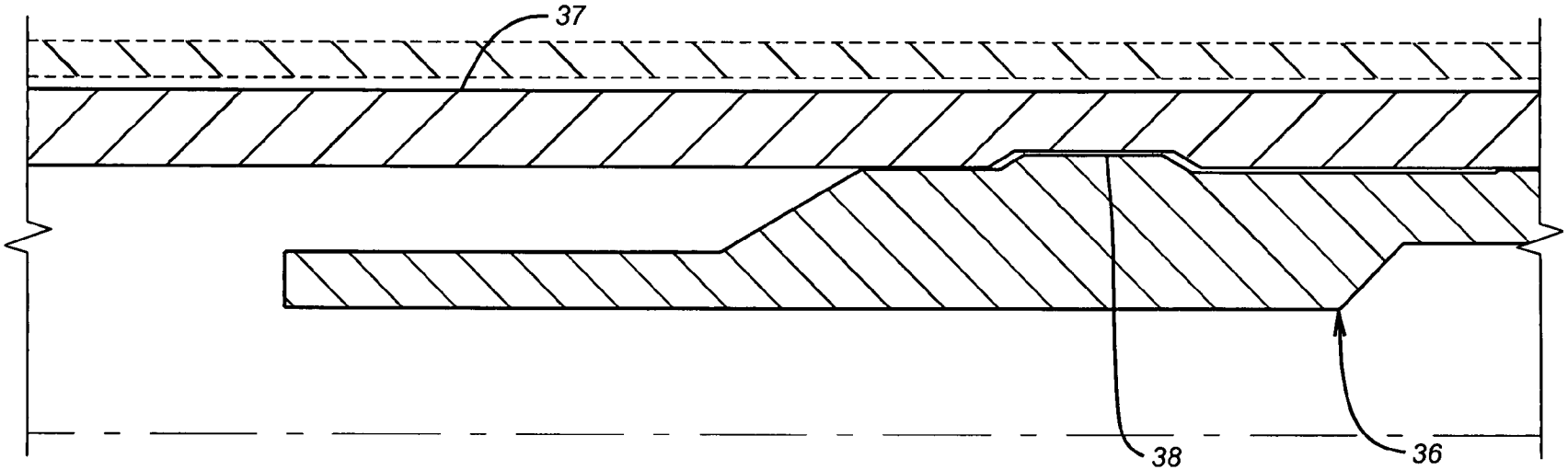
FIGS. 4*a*–4*d* show the packer schematically prior to expansion using a pressure intensifier.
Figure 5A:
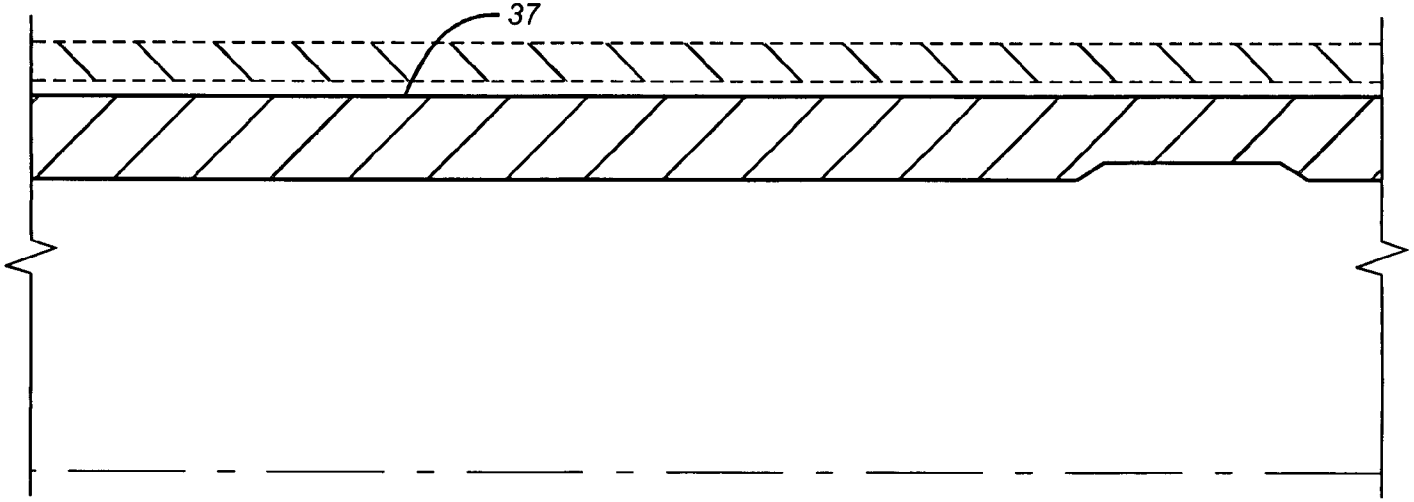
FIGS. 5*a*–5*d* show the packer of FIGS. 4*a*–4*d* in the set position with the through tubing pressure intensifier removed.
Figure 4B:
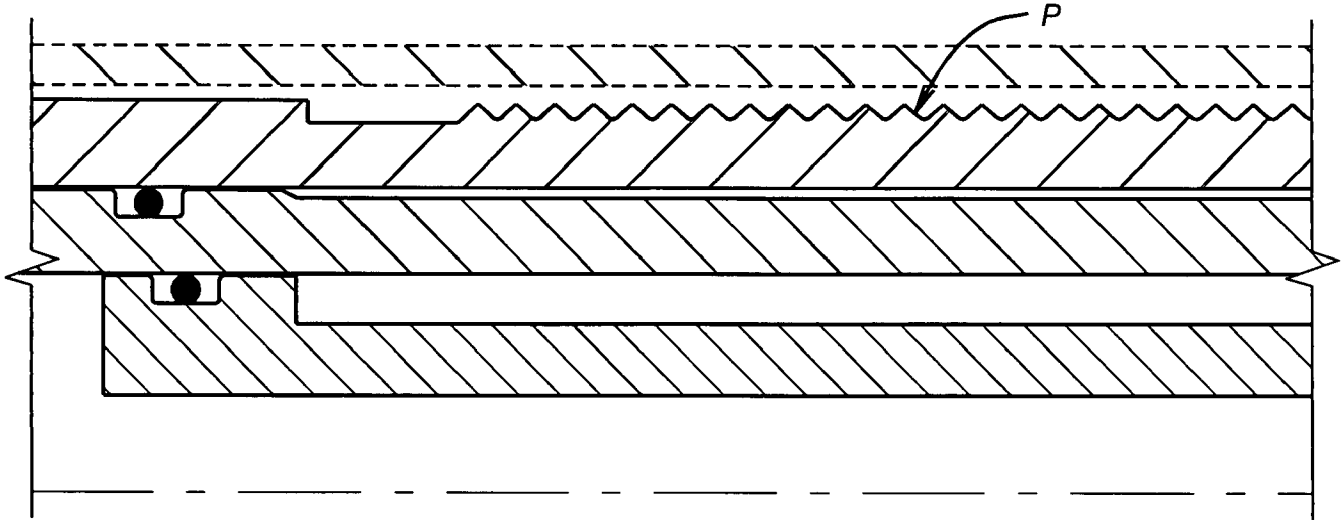
Figure 5B:
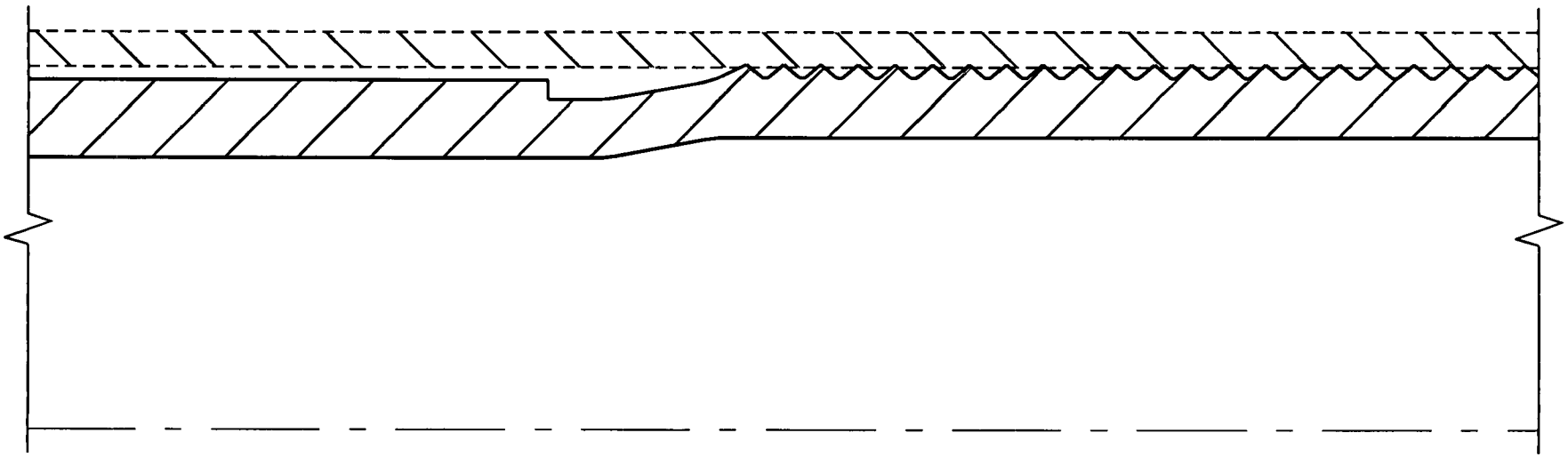
Figure 4C:
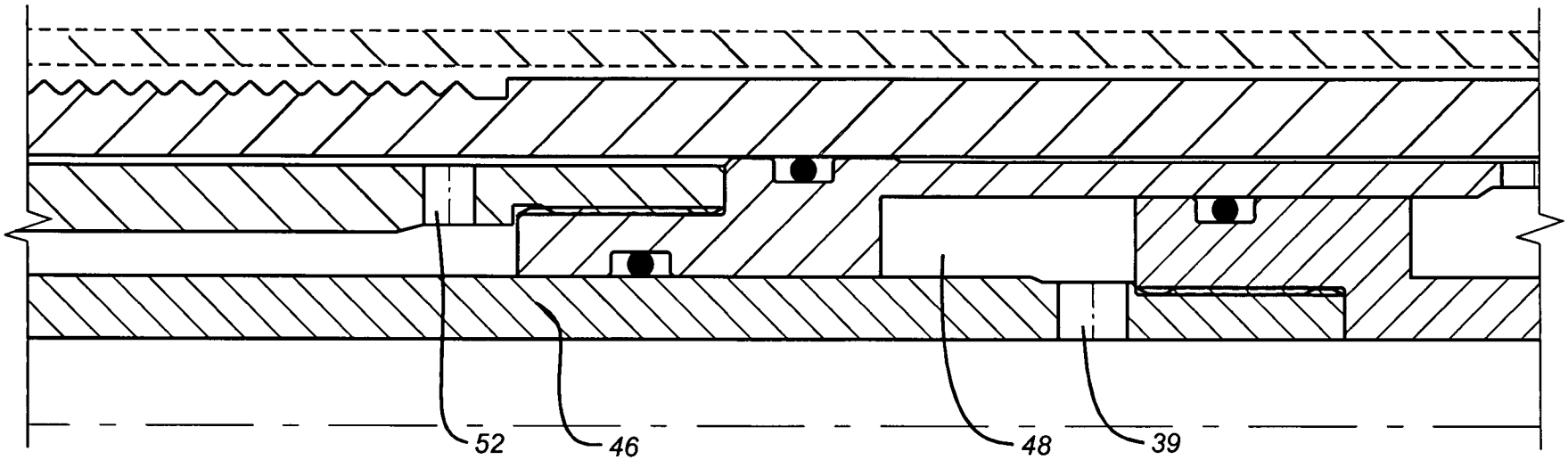
Figure 5C:
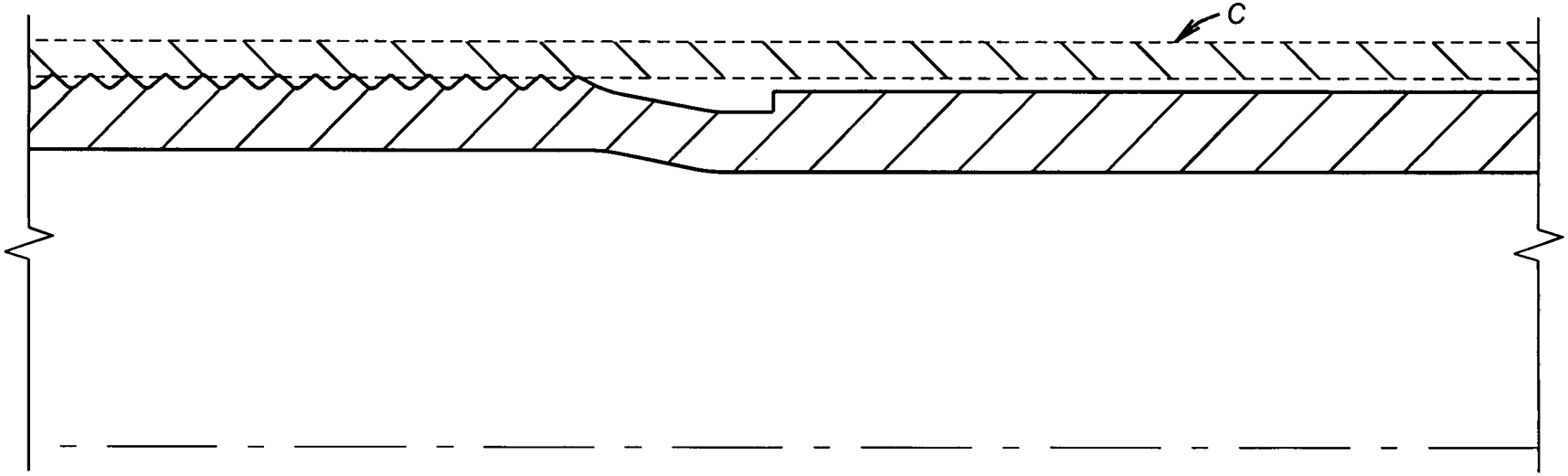
Figure 4D:
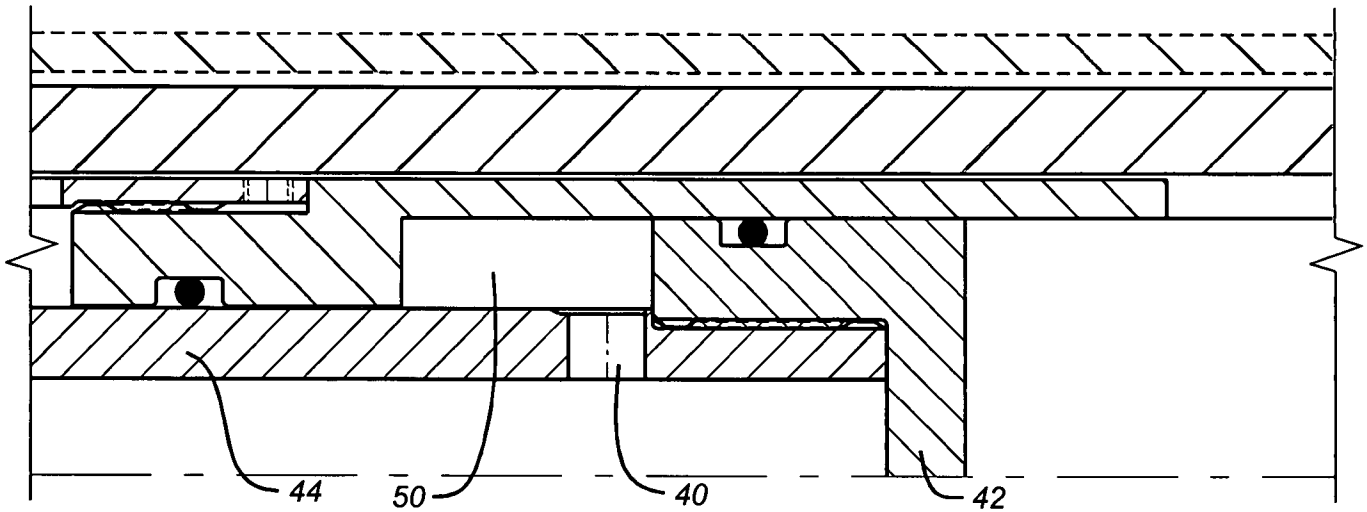
Figure 5D:
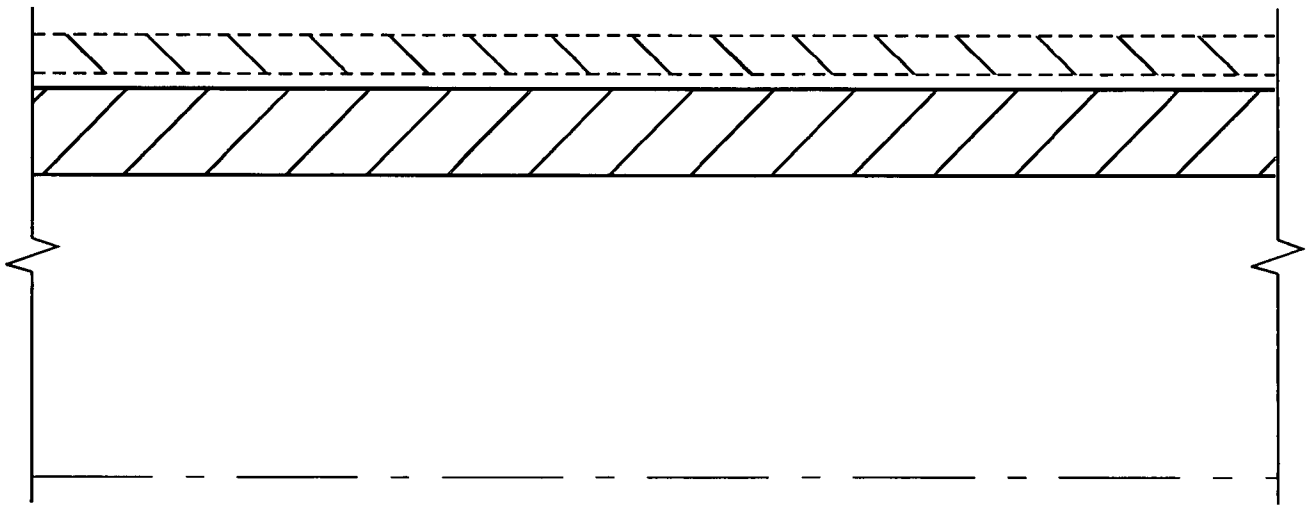

Referring to FIG. 1, the packer P has a mandrel 10 with an upper thread 12 and a lower thread 14. Upper slip ring 16 attaches at thread 12 and has extending slips 18. As shown in FIG. 3, slips 18 are fingers of preferably metal separated by slots 34. One purpose of the slots 34 is to decrease resistance to expansion. Another is to allow the wickers 32 to be hardened. If the slips were to be continuous and have hardened wickers 32, the brittleness would cause the slips to crack on expansion. Lower slip ring 20 attaches at thread 14 and has finger like slips 22 extending from it. Slips 18 and 22 each have wickers or some other surface sharpness 32 designed to dig in for a supporting bite into the casing C upon expansion of the mandrel 10. A sealing element 24 having backup rings 26 and 28 is disposed between slips 18 and 22. Those skilled in the art will appreciate that the slips 18 and 22 can be formed as an integral part of the mandrel, thus eliminating the threads 12 and 14 as well as the rings 16 and 20. In that event, the slips 18 and 22 can be a series of finger shaped protrusions from the outer surface of the mandrel 10. These protrusions can be integral, welded, or attached in some other way. Although a packer has been described, the sealing element 24 can be eliminated and the slips 18 and 22, regardless of how they are attached, can be used to anchor a tubing string (not shown) or a tool (not shown) attached to the mandrel 10, when the wickers 32 dig into the surrounding casing C. Conceivably, the expansion of the wickers 32 into the casing or outer tubular C can accomplish not only a support function but also a sealing function. Sealing is possible without having to appreciably expand the casing C or even without expanding the casing C at all. The invention can be effective with a single or multiple rings of slips, regardless of their attachment mode, and with a variety of known designs for the sealing element 24.

The clear advantage of the present invention is that cones are not required to drive the slips outwardly. This means that for a given outside diameter for run in, the packer or anchor P of FIG. 1 will have a larger internal bore diameter than a design relying on cones to ramp slips out. The larger bore possible in the mandrel 10 comes with no significant reduction of the pressure rating of the packer P.

The wickers 30 and 32 are preferably hardened to facilitate penetration into the casing. The sealing element 24 is preferably Nitrile but can also be made from other materials such as Teflon or PEEK. The backup rings 26 and 28 are preferably ductile steel and serve the function of keeping the sealing element 24 out of the slots 34 between the slips 18 and 22. Rather than slots 34 to facilitate expansion of the slips 18 and 22, the sleeve that holds the slips can be made thinner or have other openings, such as holes, to reduce its resistance to expansion. The expansion itself can be carried out with known expansion tools such as roller expanders, swages, or cones. Alternatively, an inflatable can be used to expand the mandrel 10 or a pressure technique, as illustrated in 4*a*–4*d*, 5*a*–5*d*, 12*a*–12*e*, and 13*a*–13*e*.

FIGS. 4*a*–4*d* illustrate a thru-tubing approach to setting where either a slick line or a wire line can be used to deliver a pressure intensifier 36 to a desired position where it will latch in the tubing 37 adjacent the packer or anchor P. The packer or anchor P is illustrated schematically as is the connection at the top of the intensifier 36. Pressure applied into tubing 37 enters ports 39 and 40. Pistons 42, 44, and 46 are connected together for tandem movement. Pressure from ports 39 and 40 enters cavities 48 and 50 to apply downward forces on pistons 42, 44, and 46. Additional pistons can be used for greater force amplification. The use of intensifier 36 allows a lower pressure to be used at the wellhead in case it has a low pressure rating and the expansion force desired at the packer or anchor P exceeds the rated wellhead pressure. Downhole movement of piston 46 forces fluid out of port 52 to expand the packer or anchor P. The intensifier 36 is retrieved after expansion with a known fishing tool, which engages a fishing neck in the top of the intensifier. As shown in FIGS. 5*a*–5*d*, the packer or anchor P is set against tubular or casing C and the intensifier is removed from the tubing 37.

Figure 12A:
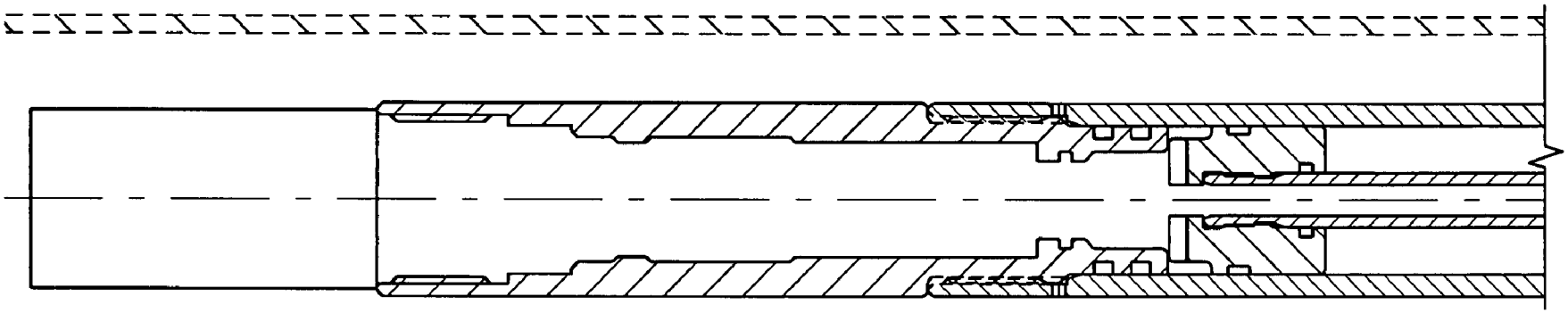
FIGS. 12*a*–12*e* show the packer run in with a wire line or hydraulic setting tool in the run in position.
Figure 12B:
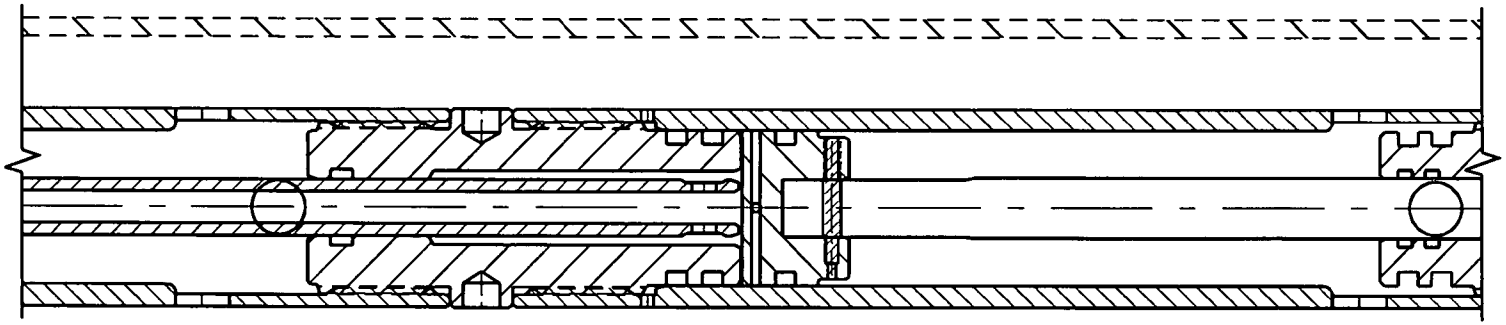
Figure 12C:
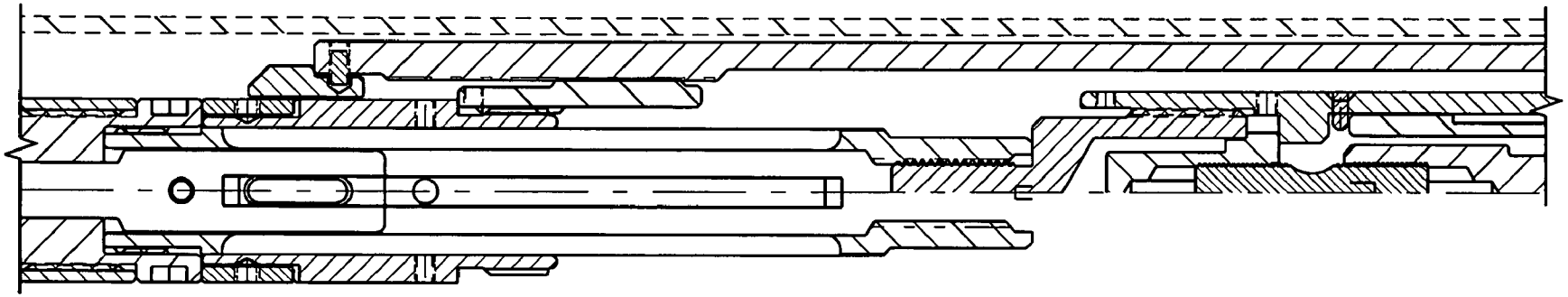
Figure 12D:
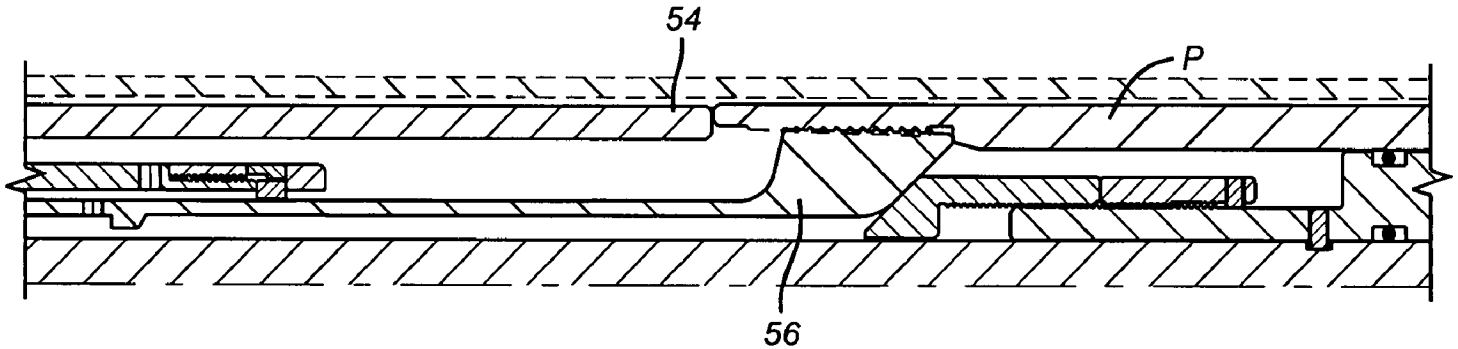
Figure 13D:
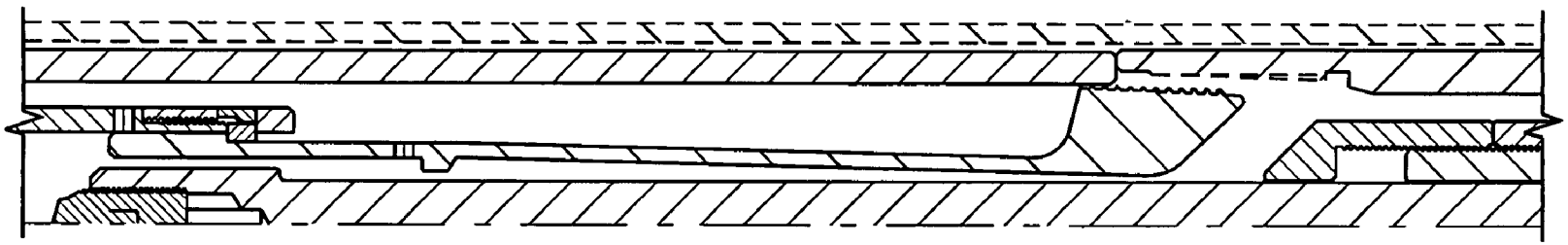
Figure 12E:
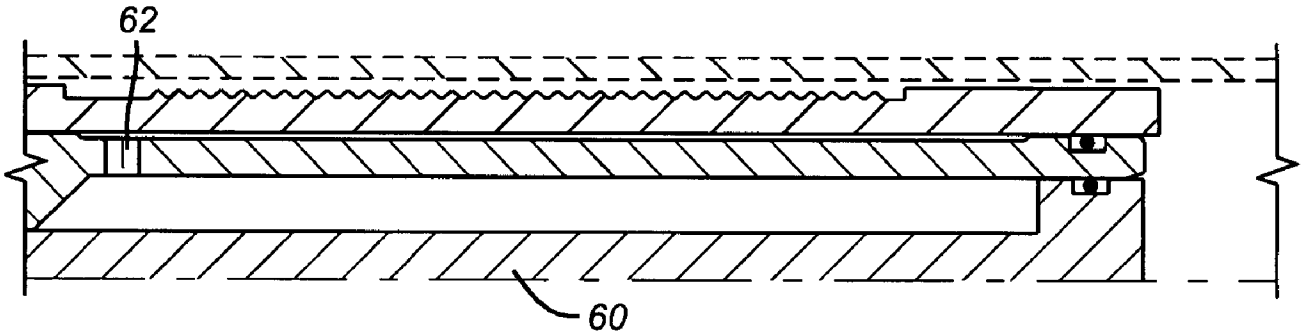
Figure 13E:
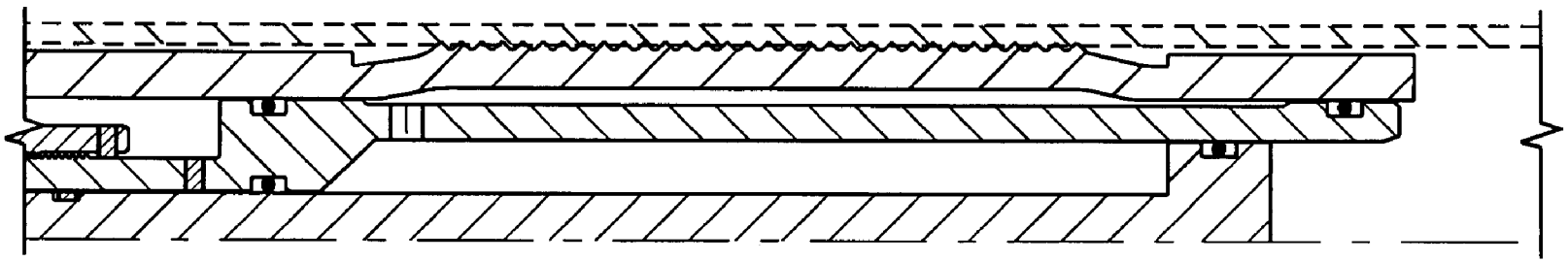

Another way to deliver and set the packer or anchor P is shown in FIGS. 12*a*–12*e* and 13*a*–13*e*. In these figures the packer or anchor P is delivered on a hydraulic or wire line setting tool, as opposed to the through-tubing techniques previously described. The setting tool is schematically illustrated to cover the use of both hydraulic or wire line setting. A sleeve 54 abuts the top of the packer or anchor P (FIG. 12*d*). A gripping sleeve 56 retains the packer or anchor P until the shear stud 58 fails. Circulation is possible when using the hydraulic setting tool until an object is dropped to allow pressure buildup to ultimately move piston 60 to set the packer or anchor P. Upward movement of the piston 60 breaks the shear stud 58 after delivering the required pressure for expansion through port 62 to the packer or anchor P. The hydraulic setting tool can incorporate pressure intensifiers so as to limit the surface pressure applied to get the desired expansion, in the event the wellhead has a low pressure rating. Breaking the shear stud 58 allows removal of the setting tool and a subsequent tagging the packer with production tubing. The pressure intensifier can have more or fewer pistons to get the desired pressure amplification. Hydrostatic pressure can be employed to do the expanding instead of or in conjunction with surface applied pressure. Various ways can be used to connect the tubing to the packer. The expansion tool can be released from the packer by rotation. Known setting tools can be employed such as those made by Baker Oil Tools under model numbers BH, BHH, B-2 and J with only slight adaptations.

In a wire line variation, the setting tool would be electrically actuated to set off an explosive charge to create the needed pressure for expansion of the packer or anchor P in the manner previously described with the possibility of integrating a pressure intensifier. Once the packer or anchor P is expanded, an automatic release from the setting tool occurs so that it could be removed. Known wire line setting tools like the E-4 made by Baker Oil Tools can be used, or others. The expansion concept is the same, stroking a piston with a pressure source and, if necessary a pressure intensifier, creates the pressure for expansion of the packer or anchor P to expand it into position against the tubular or casing C and to trigger an automatic release for retrieval of the settling tool. After the setting tool is pulled out, tubing is tagged into the expanded packer or anchor.

Figure 6A:
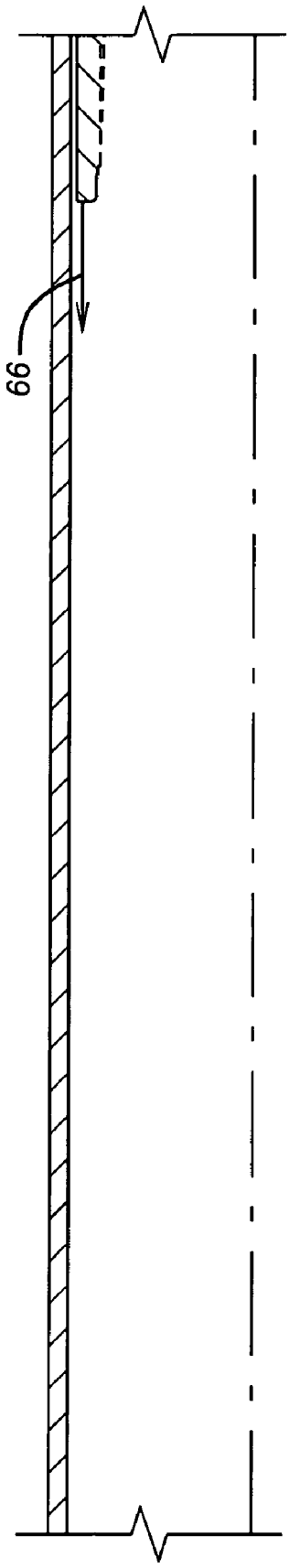
FIGS. 6*a*–6*b* show schematically how force is to be applied to release the packer.
Figure 7A:
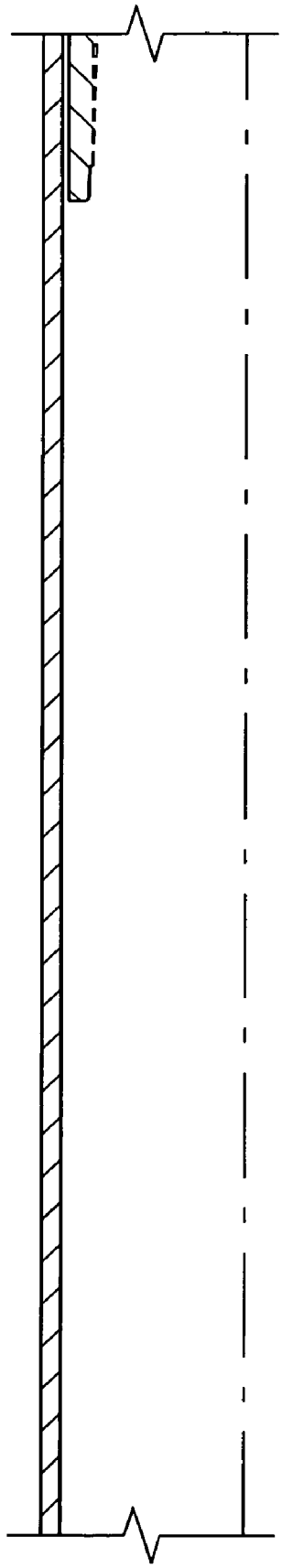
FIGS. 7*a*–7*b* show the released position of the packer after applying the forces shown in FIGS. 6*a*–6*b;*
Figure 6B:
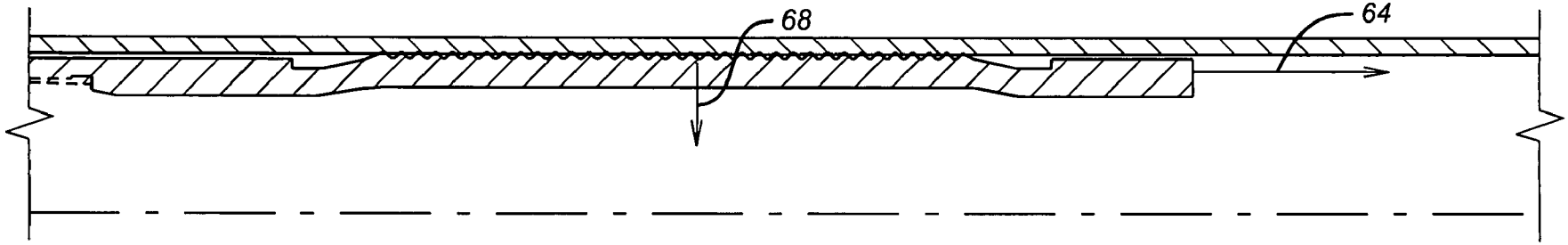
Figure 7B:
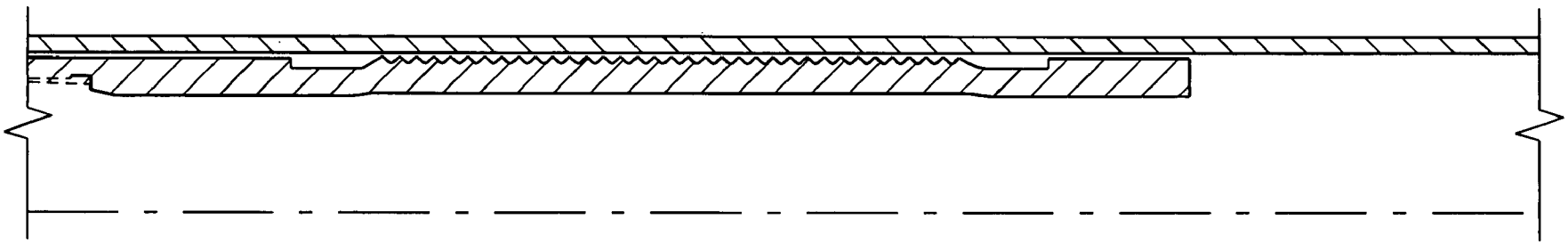

Release of the packer or anchor P is schematically illustrated in FIGS. 6*a*–6*b*. The technique is longitudinal extension as illustrated by opposed arrows 64 and 66. This longitudinal extension results in radial contraction, shown schematically as arrow 68. What actually occurs is that the wickers 30 and 32 (shown in FIG. 1), which had dug into the casing C on expansion, are pulled or sheared out of the casing. The longitudinal extension also draws back the sealing element 24 as the mandrel under it radially contracts. FIGS. 7*a*–7*b* show the released position.

Figure 8A:
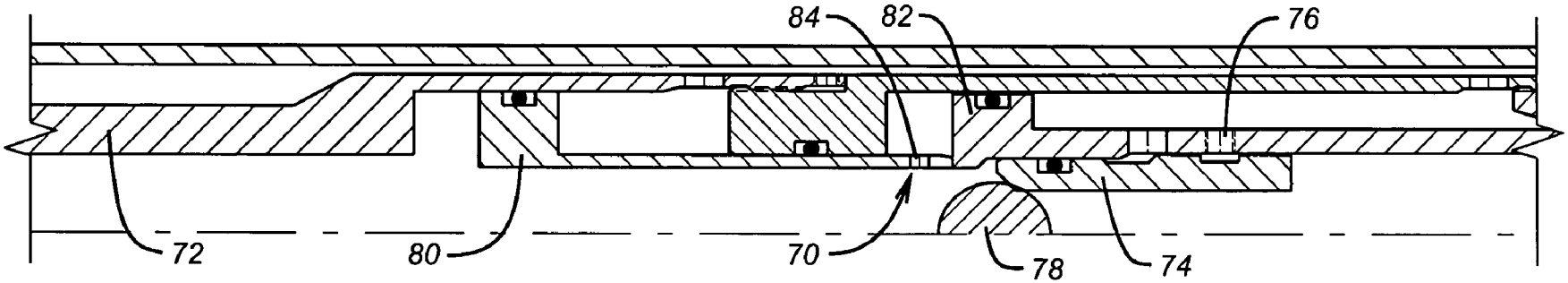
FIGS. 8*a*–8*b* show one version of a release tool for the packer where the release tool is tubing delivered to latch to the top of the packer.
Figure 8B:
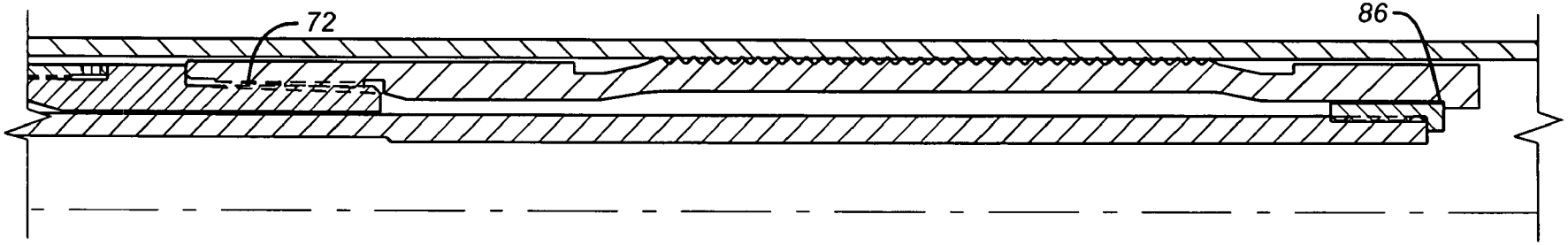

One way to accomplish the release as described above is shown in FIGS. 8*a*–8*b*. The release tool 70 is run into the well after the production tubing is pulled. It is secured downhole to the packer at connection 72, which can be a variety of configurations. A ball seat 74 is retained by shear pins 76 and accepts a ball 78 dropped from the surface. Built up pressure pushes down of piston 80 and piston 82 through port 84. Piston 80 bears down on piston 82. Piston 82 bears on shoulder 86 on the packer or anchor P. Thus the packer or anchor P is subjected to a longitudinal extension from an uphole force at connection 72 and a downhole force at shoulder 86. The resulting radial retraction allows removal of the packer or anchor P with the tubing 72.

Figure 9A:
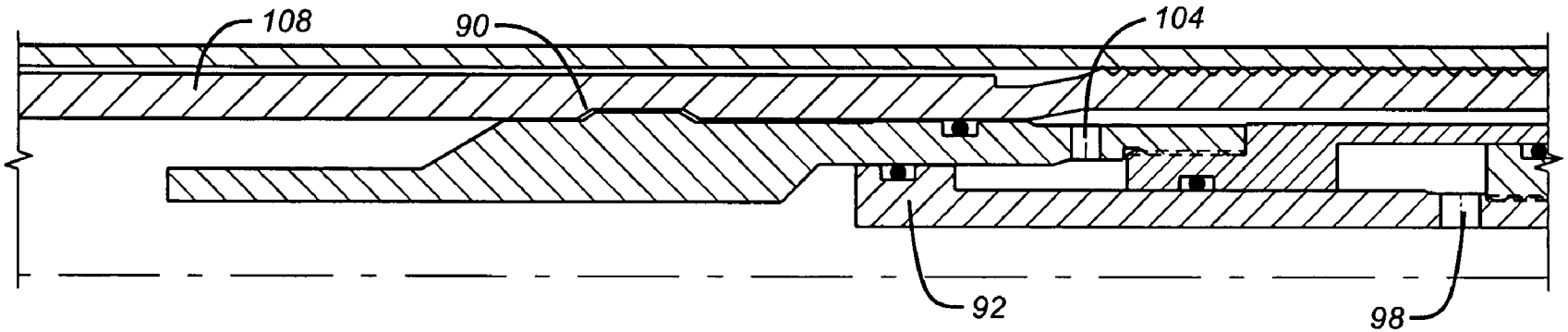
FIGS. 9*a*–9*b* show a through tubing release tool, which can be delivered on wire line or slick line.
Figure 9B:
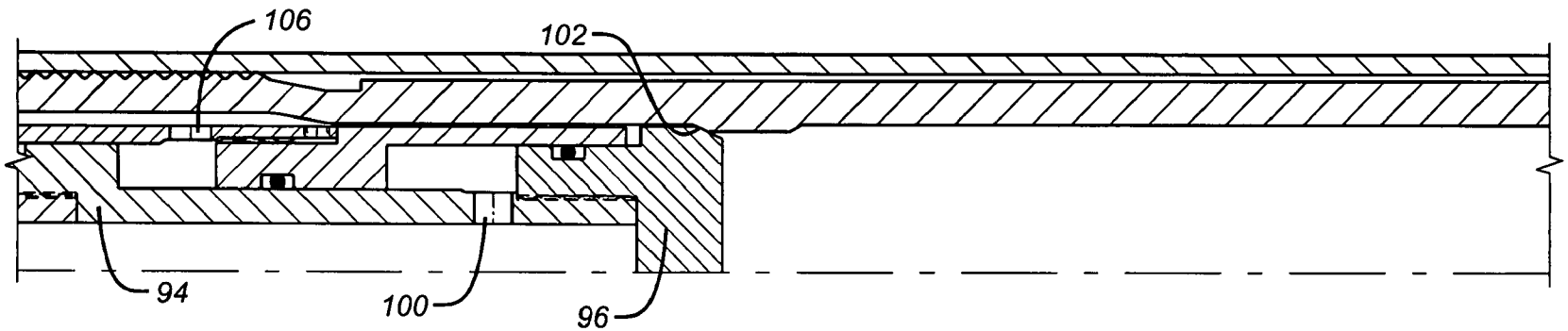
Figure 10A:
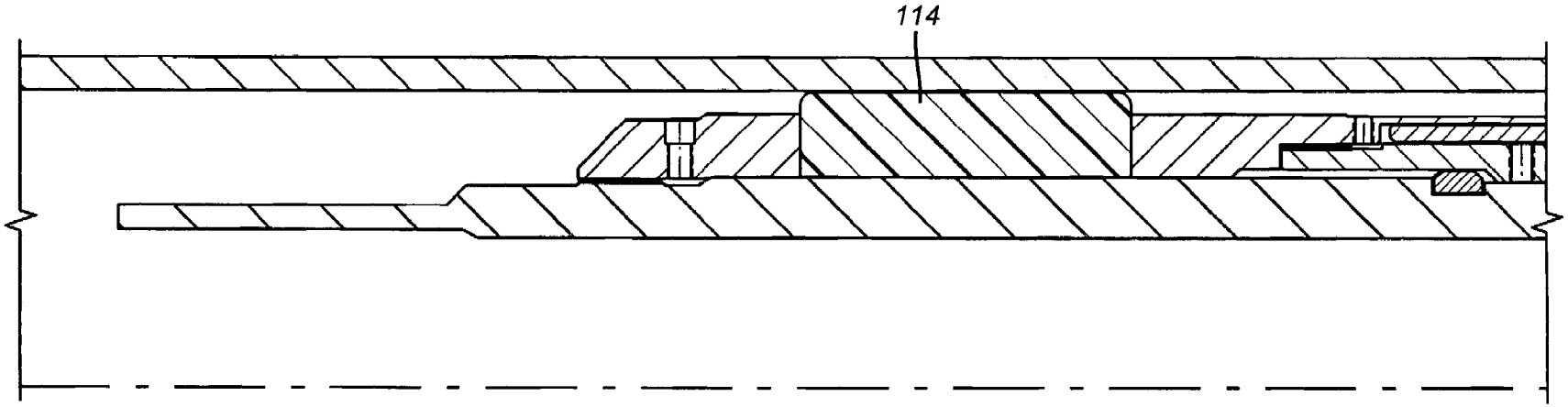
FIGS. 10*a*–10*d* show a packer with a mandrel having a thin wall segment with a release tool inserted through tubing and the packer in the set position.
Figure 10B:
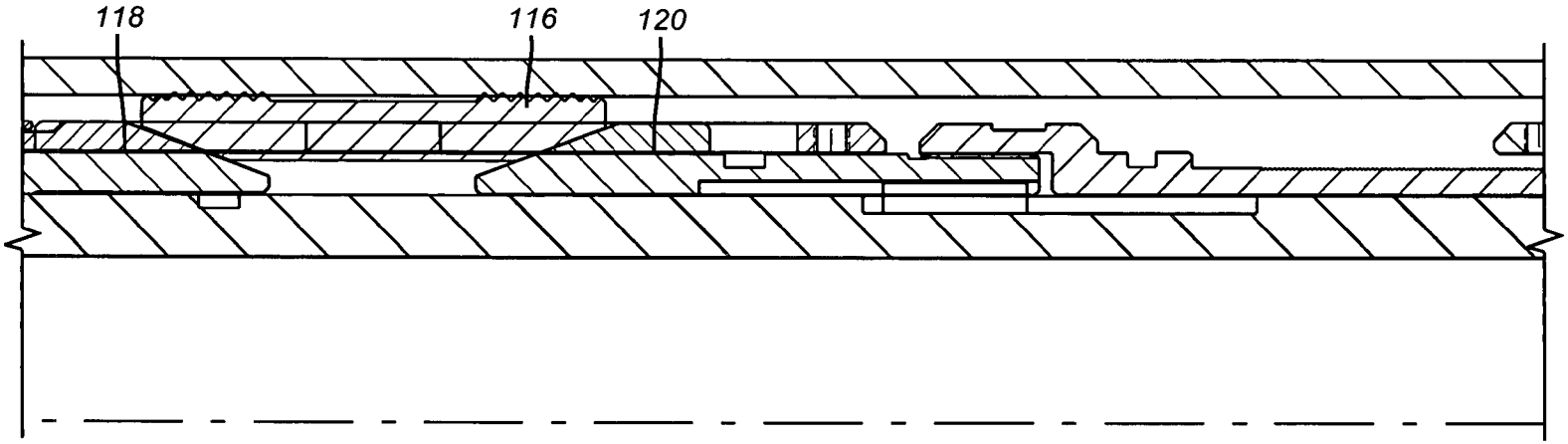
Figure 10C:
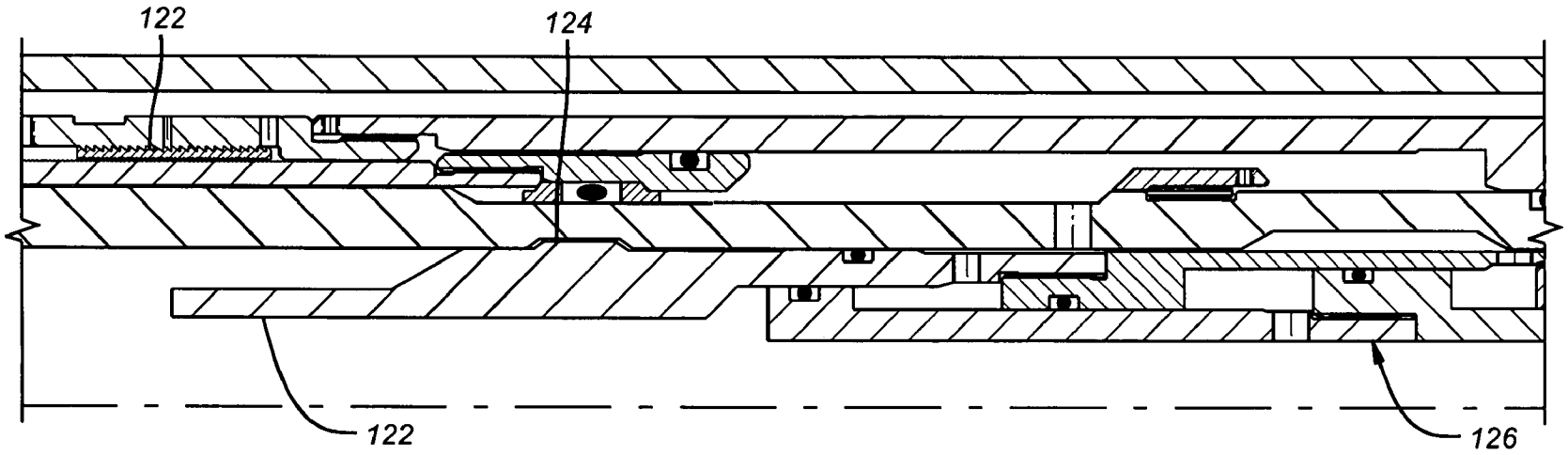
Figure 10D:
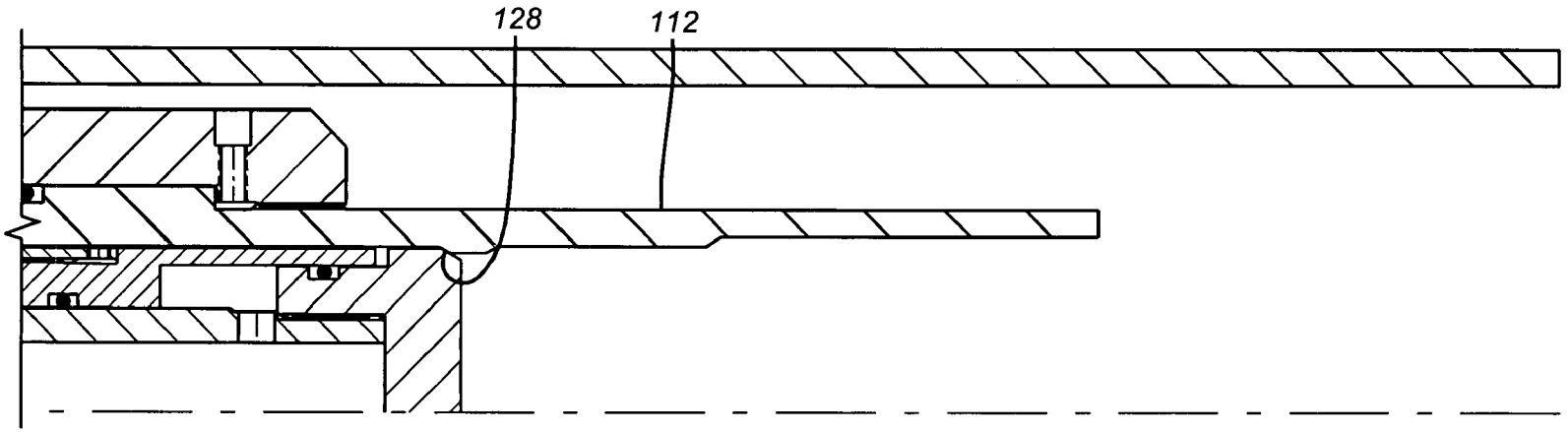

FIGS. 9*a*–9*b* show a thru-tubing variation of the release technique. The release tool 88 can be run in on slick line or wire line to latch into latch 90. Pressure is developed on pistons 92, 94, and 96. Ports 98 and 100 allow access to pistons 94 and 96 respectively. Piston 92 bears on piston 94, which in turn bears on piston 96. Piston 96 rests on shoulder 102 on the anchor or packer P while the other end of the release tool 88 is latched at latch 90. Ports 104 and 106 allow pistons 92 and 94, respectively to move by allowing fluid to pass. Accordingly, applied pressure in tubing 108 or generated pressure from an electric line setting tool such as an E-4 made by Baker Oil Tools, stretches the packer or anchor P to get the slips 18 and 22 (see FIG. 1) to let go of their grip of the tubular or casing C in the manner previously described.

Figure 11A:
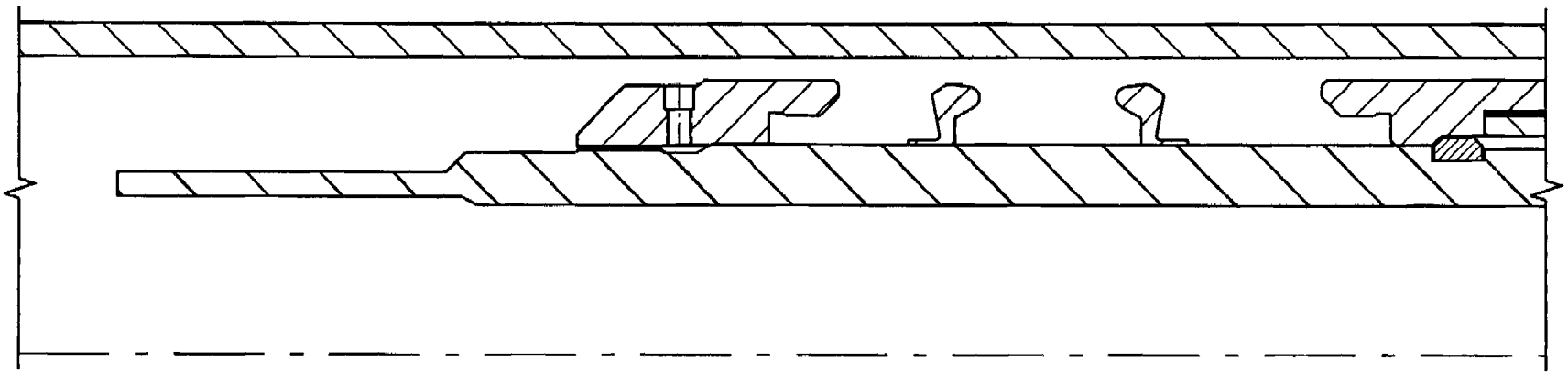
FIGS. 11*a*–11*d* show the packer of FIGS. 10*a*–10*d* in the released position.
Figure 11B:
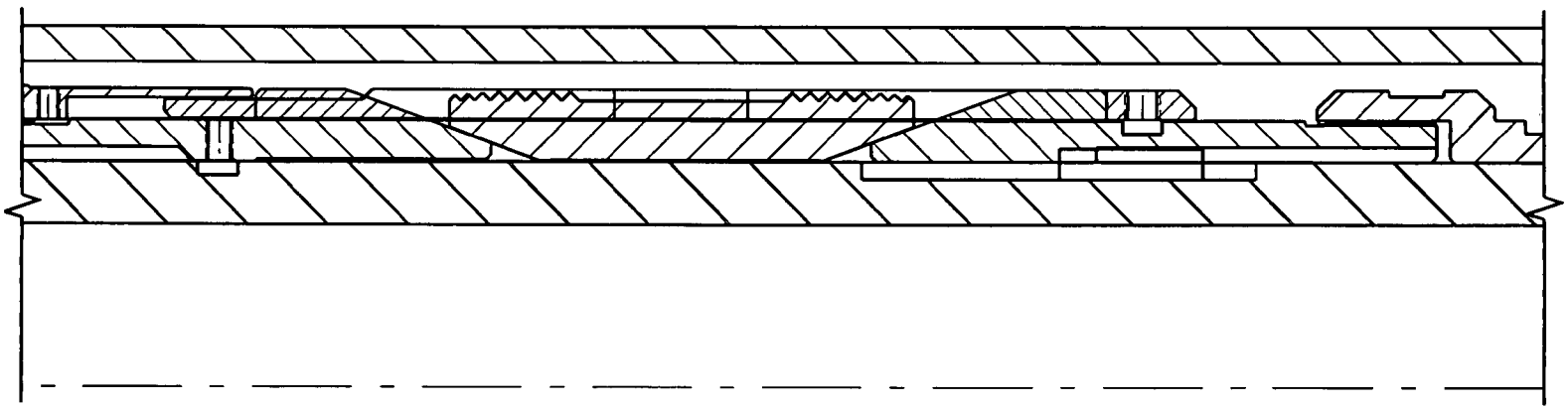
Figure 11C:
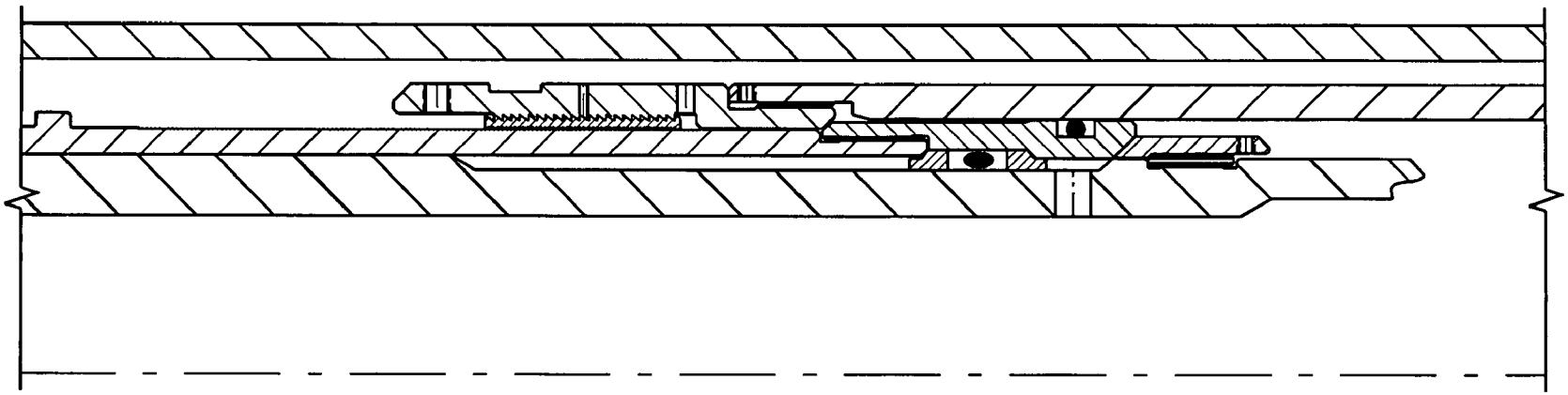
Figure 11D:
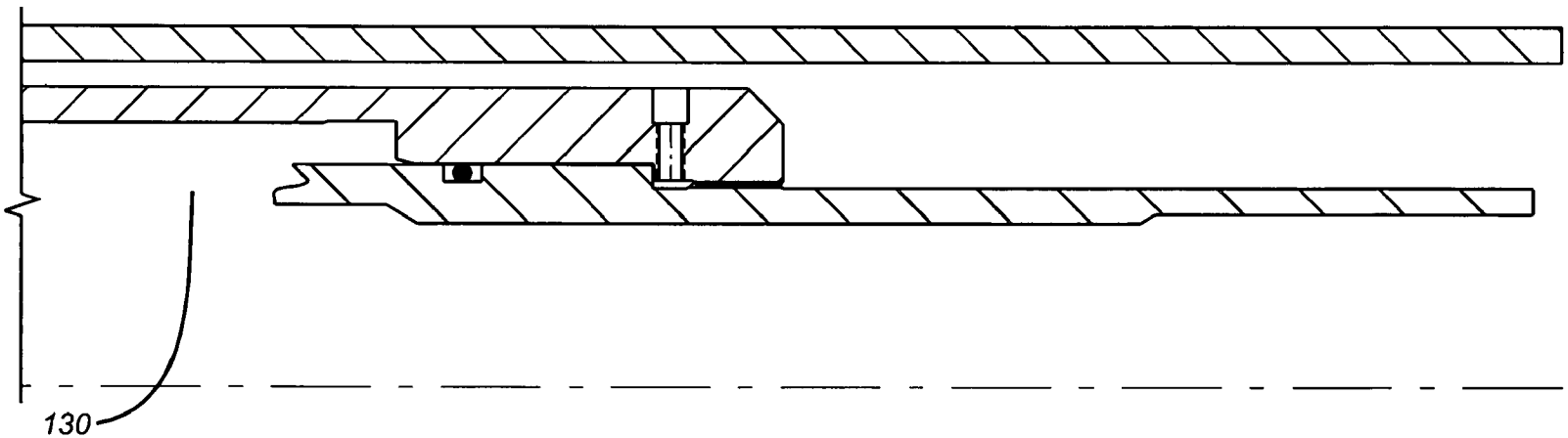
Figure 13A:
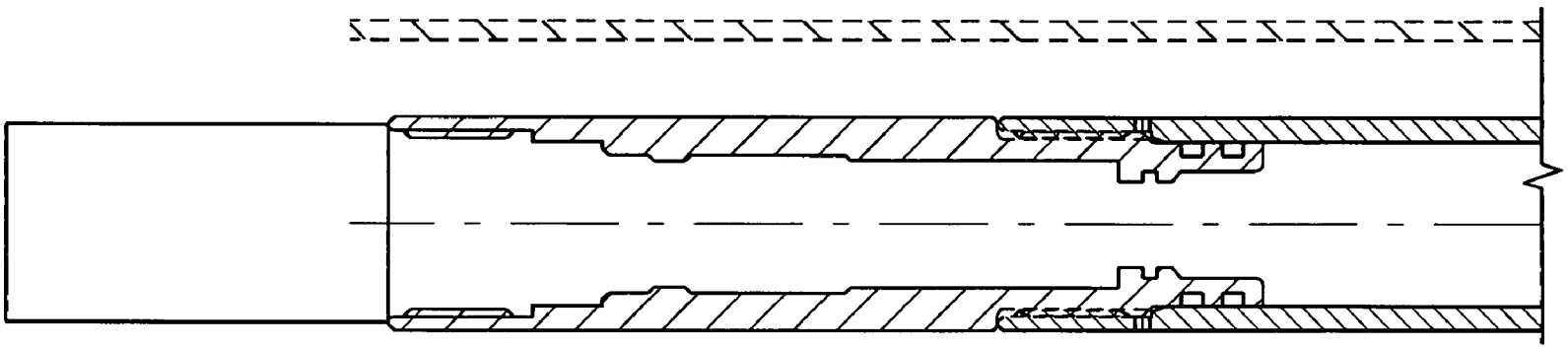
FIGS. 13*a*–13*e* show the packer of FIGS. 12*a*–12*e* in the set position with the setting tool released.
Figure 13B:
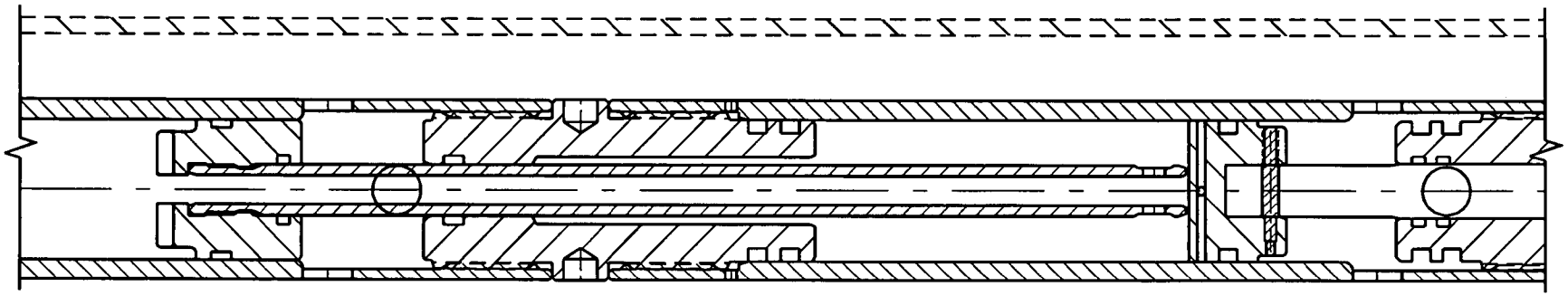
Figure 13C:
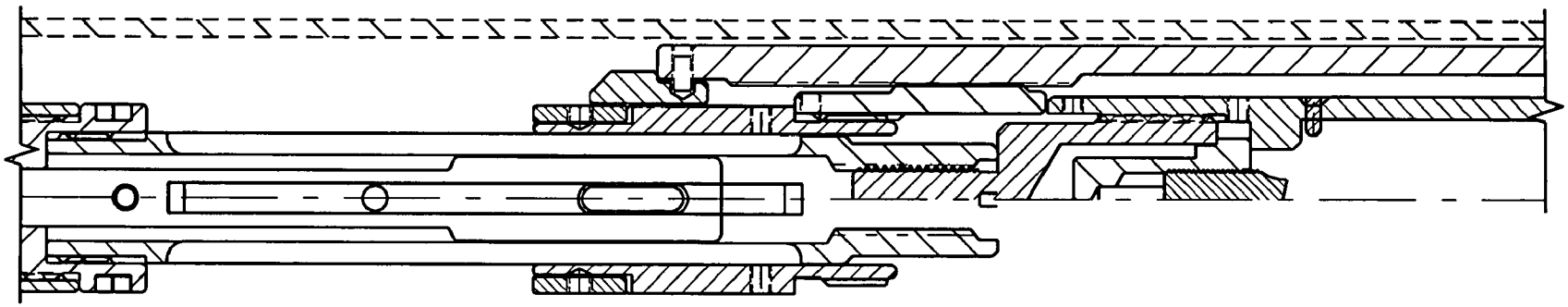

FIGS. 10*a*–10*d* and 11*a*–11*d* show a packer of known construction except that it has a narrow portion 110 in its mandrel 112. It has a sealing element 114 and slips 116 extendable with cones 118 and 120. The set is held by a lock ring 122. In the past, the packer could be released by releasing the lock ring by cutting the mandrel of the set packer downhole, as illustrated in U.S. Pat. No. 5,720,343. However this technique had its uncertainties due to doubts about placement of the cutter and knowledge as to if the cut was completed. The release technique for such packers of the present invention, removes such uncertainties. The release tool 122 can be run thru-tubing on slick line or wire line and latched at latch 124. A pressure intensifier 126 of the type previously described rests on shoulder 128 of the packer or anchor P. Application of pressure from the surface or the electric line tool puts opposing forces at latch 124 and shoulder 128 until the narrow portion 110 fails in tension. This releases the hold of the set position by the lock ring 122 and allows extension and radial retraction of the slips 116 and the sealing element 114. The break 130 is shown in FIG. 11*d*. If there are multiple packers or anchors P in the well, the process can be repeated for each one that is needed to be released. As well, the setting process can be repeated to set in any order desired, other packers or anchors P to isolate a desired zone for example. The release tool can be delivered through the production tubing or on wire line or slick line after the production tubing has been removed.

Other downhole tools can be expanded and extended for release in the manner described above other than packers or anchors. Some examples are screens and perforated liners.

The techniques described above will also allow for expansion and extension of a variety of tools more than a single time, should that become necessary in the life of the well. Extension of the downhole tool for release does not necessarily have to occur to the extent that failure is induced, as described in conjunction with FIGS. 10 and 11. The extension of a tool such as the packer or anchor P an embodiment of which is shown in FIG. 1, can allow it to be re-expanded with the variety of tools described above.

Tubing itself can also be expanded and extended for release using the techniques described above.

Although the retrieving tool has been illustrated as abutting a shoulder to obtain the extension, the shoulder can be provided in a variety of configurations or can be replaced with a gripping mechanism such as slips on the release tool. The slips could alternatively replace the latching notch while still putting a downhole force on the lower shoulder. The mandrel can also have an undercut and collets can engage the undercut to put the requisite extension force on the mandrel body.

Selected zones can be isolated or opened for flow with the techniques previously described. Pressure intensifiers of various designs and pressure magnifications can be used or, alternatively, no pressure magnification device can be used.

If the through-tubing tool is used with the explosive charge as the pressure source, then it will need to be removed and the charge replenished before it is used to expand another device in the well. The hydraulically operated through-tubing tool can simply be repositioned and re-pressurized to expand another downhole packer, tubular or other tool.

The various forms of the release tools can be used with conventional packers that set with longitudinal compression of a sealing element and slips with the set held by a lock ring by extending that packer to the point of mandrel or other failure, which can release the set held by the lock ring.

The above description is illustrative of the preferred embodiment and many modifications may be made by those skilled in the art without departing from the invention whose scope is to be determined from the literal and equivalent scope of the claims below.

We claim:

1. A method of running a first tubular in a wellbore, said wellbore comprising an open hole or cased hole, comprising:

inserting the first tubular in to the wellbore;

expanding said first tubular in the wellbore for support thereof;

using a pressure intensifier for said expanding;

longitudinally extending said first tubular to retract it from the wellbore;

removing said first tubular.

2. A method of running a first tubular in a wellbore, said wellbore comprising an open hole or cased hole, comprising:

inserting the first tubular having an innermost wall in to the wellbore;

expanding said innermost wall of first tubular in the wellbore for support thereof using only the direct application of fluid pressure to an inner wall thereof;

using a pressure intensifier for said expanding;

longitudinally extending said first tubular to retract it from the wellbore.

* * * * *